US006019108A

United States Patent [19]

Chen

[11] Patent Number: 6,019,108

[45] Date of Patent: Feb. 1, 2000

[54] ENGAGING ARRANGEMENT FOR A HAIR HOLDER

[76] Inventor: Chin-Chin Chen, No. 48 Dwan Ming St., Hsiaokang District, Kaohsiung, Taiwan

[21] Appl. No.: 09/247,869

[22] Filed: Feb. 11, 1999

[51] Int. Cl.[7] ..... A45D 8/00; A45D 8/20; A45D 8/04

[52] U.S. Cl. ..... 132/276; 132/277; 132/273

[58] Field of Search ..... 132/276, 277, 132/278, 279, 273, 275; D28/38, 39, 40, 41

[56] References Cited

U.S. PATENT DOCUMENTS

| | | | |
|---|---|---|---|
| 2,637,328 | 5/1953 | Behr | 132/276 |
| 3,983,887 | 10/1976 | Chan | 132/277 |
| 4,141,119 | 2/1979 | Nodo | 24/250 |
| 5,549,127 | 8/1996 | Chang | 132/277 |
| 5,642,740 | 7/1997 | Chen | 132/277 |
| 5,735,296 | 4/1998 | Chen | 132/277 |
| 5,787,905 | 8/1998 | Yasuda | 132/277 |
| 5,842,482 | 12/1998 | Potut | 132/277 |
| 5,862,815 | 1/1999 | Murphy et al. | 132/277 |
| 5,865,190 | 2/1999 | Butler | 132/208 |
| 5,873,377 | 7/1998 | Yang | 132/277 |
| 5,881,741 | 3/1999 | Chen | 132/277 |

*Primary Examiner*—John J. Wilson
*Assistant Examiner*—Robyn K. Doan
*Attorney, Agent, or Firm*—Larson & Taylor

[57] ABSTRACT

A hair holder includes a first body, a second body, and an elastic member. The first body includes a mounting seat formed on an end thereof and a first retaining groove defined in the end thereof. The mounting seat includes a protruded member on each of two opposite end faces thereof. The first body further includes two restraining blocks formed thereon. The second body includes two spaced engaging pieces formed on an end thereof and a second retaining groove defined in the end thereof. Each engaging piece includes a device for rotatably pivotally holding the protruded members of the mounting seat of the first body. The elastic member is mounted in the mounting seat of the first body and restrained by the restraining blocks. The elastic member has a first end retained in the first retaining groove and a second end retained in the second retaining groove.

6 Claims, 6 Drawing Sheets

ENGAGING ARRANGEMENT FOR A HAIR HOLDER

BACKGROUND OF THE INVENTION

1. Field of the Invention

The present invention relates to an engaging arrangement for a hair holder that allows the hair holder to be assembled easily.

2. Description of the Related Art

A wide variety of hair holders have heretofore been provided, and typical examples are U.S. Pat. No. 5,549,127 to Chang issued on Aug. 27, 1996, U.S. Pat. No. 5,642,740 to Chen issued on Jul. 1, 1997, and U.S. Pat. No. 5,737,296 to Chen issued on Apr. 7, 1998. A common disadvantage of these U.S. Patents is that assembly of the pin into the aligned holes in the lugs of the two bodies of the hair holder is inconvenient and time-consuming. The present invention is intended to provide an improved hair holder to solve this problem.

SUMMARY OF THE INVENTION

It is a primary object of the present invention to provide an improved hair holder that is simple in structure and easy to assemble.

A hair holder in accordance with the present invention comprises a first body, a second body, and an elastic member. The first body includes a mounting seat formed on an end thereof and a first retaining groove in the end thereof. The mounting seat includes a protruded member on each of two opposite end faces thereof. The first body further includes two restraining blocks formed thereon.

The second body includes two spaced engaging pieces formed on an end thereof and a second retaining groove defined in the end thereof. Each engaging piece includes means for rotatably pivotally holding the protruded members of the mounting seat of the first body.

The elastic member is mounted in the mounting seat of the first body and restrained by the restraining blocks. The elastic member has a first end retained in the first retaining groove and a second end retained in the second retaining groove.

By such arrangement, neither the mounting seat of the first body nor the engaging pieces of the second body require pivotal holes, and the pivotal pin is also not required. The assembly is simple and not time-consuming accordingly.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
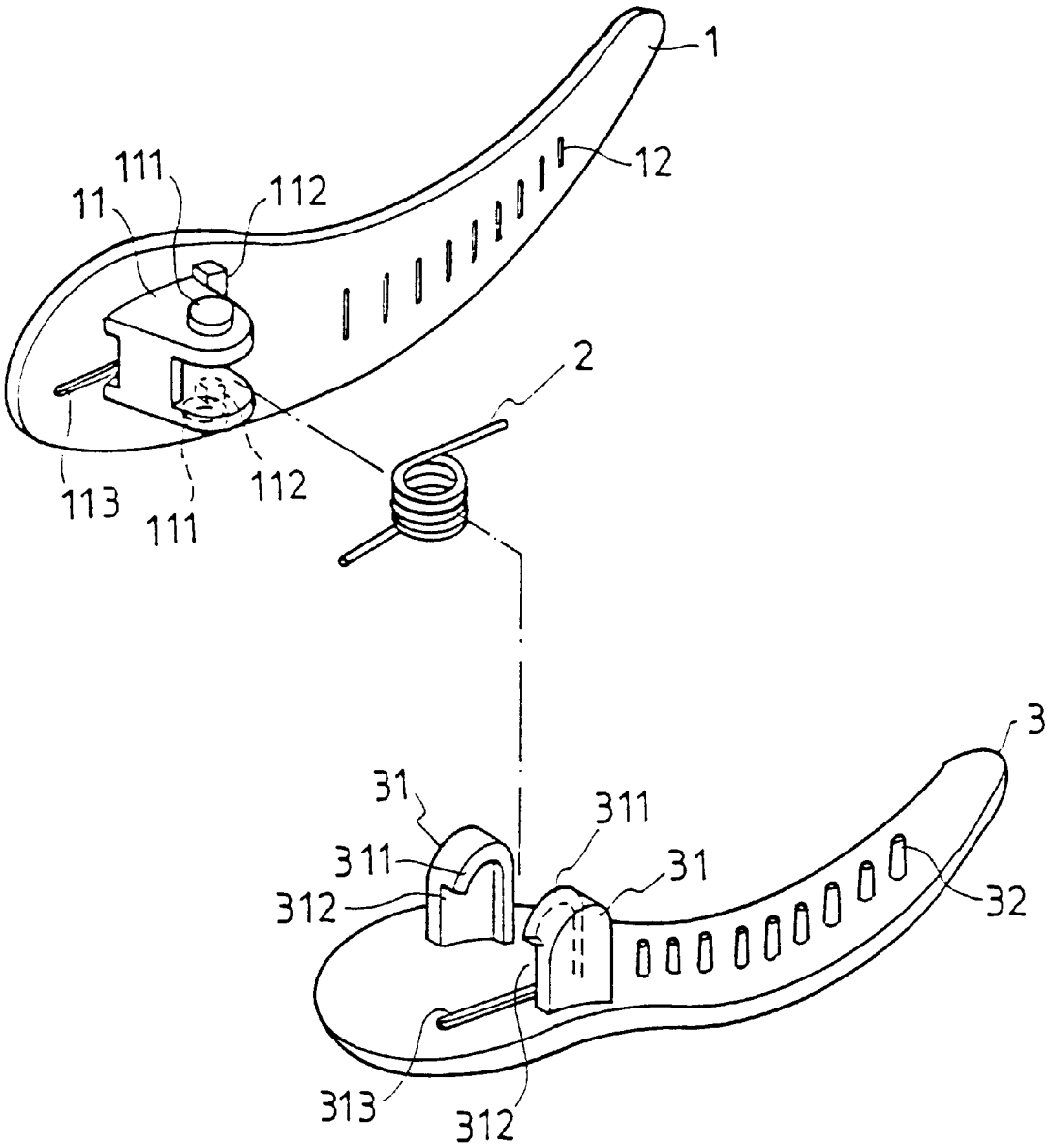
FIG. 1 is an exploded perspective view of a first embodiment of a hair holder in accordance with the present invention.

Referring to FIG. 1, a first embodiment of a hair holder in accordance with the present invention generally includes a first body 1, an elastic member 2 (e.g., a torsion spring), and a second body 3. The first body 1 includes a mounting seat 11 formed on an end of a side thereof and a first retaining groove 113 defined in the end of the side thereof. The mounting seat 11 includes a circular protrusion 111 on each of two opposite end faces thereof. The mounting seat 11 further includes two restraining blocks 112 formed adjacent to each of two ends of a lateral side thereof. The second body 3 includes two spaced engaging pieces 31 formed on an end of a side thereof and a second retaining groove 313 defined in the end of the side thereof. Each engaging piece 31 includes an annular wall 311 with a notch 312. The bodies 1 and 3 may be made of plastics or other suitable material.

Figure 2:
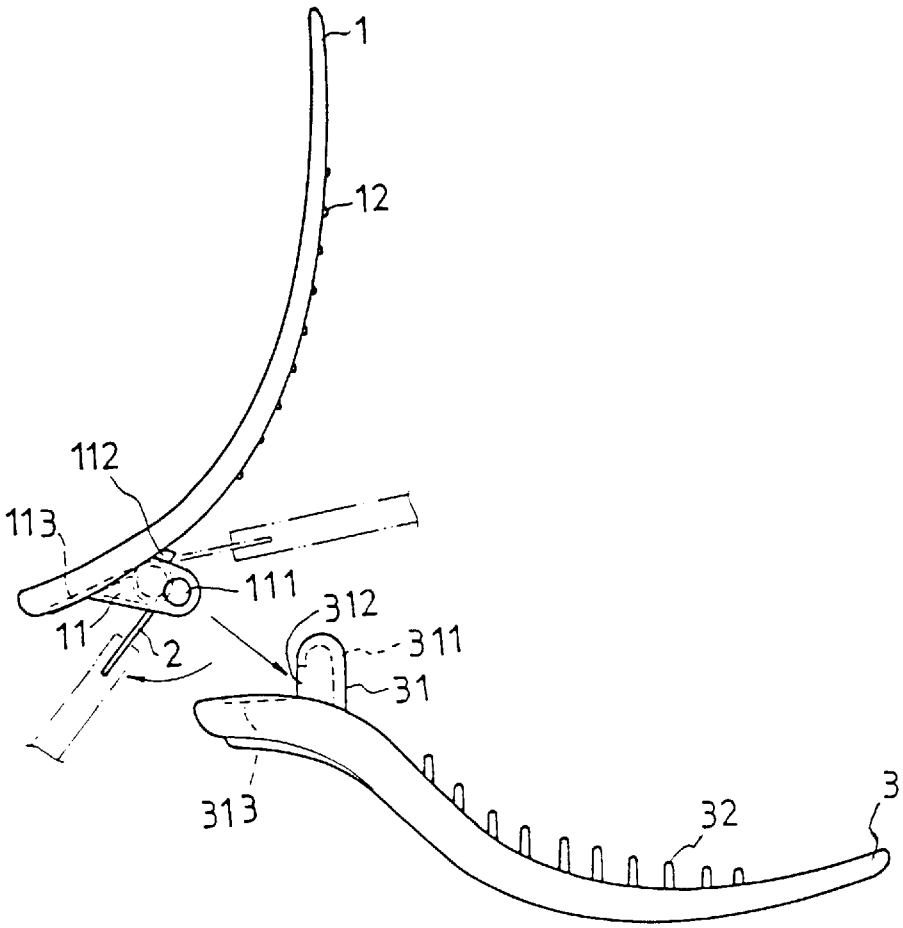
FIGS. 2 and 3 are side views illustrating assembly of the first embodiment of the hair holder in accordance with the present invention.
Figure 3:
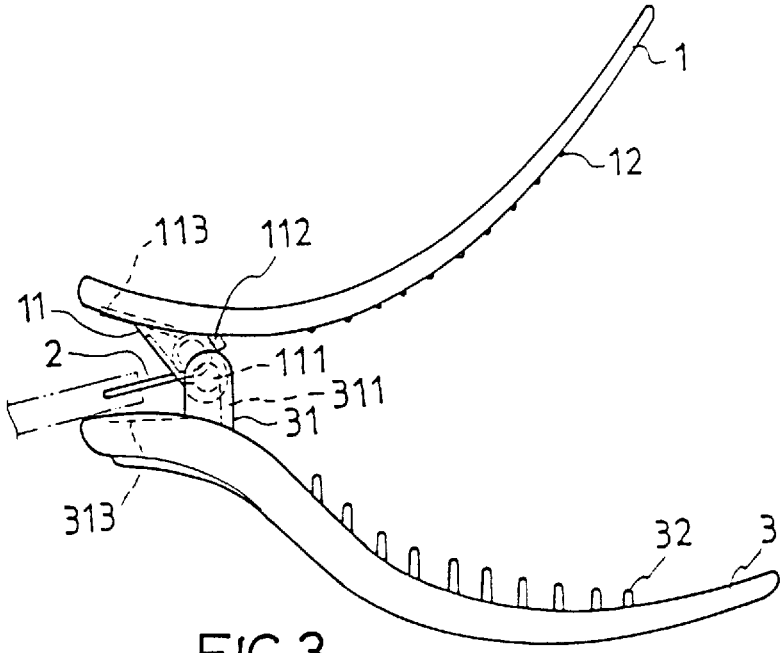
Figure 4:
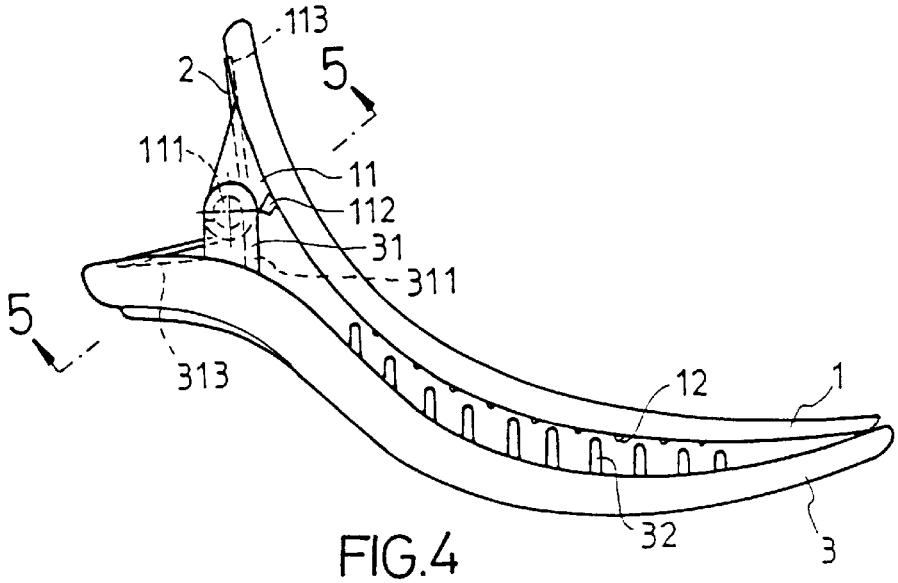
FIG. 4 is a side view of the first embodiment of the hair holder in accordance with the present invention.
Figure 5:
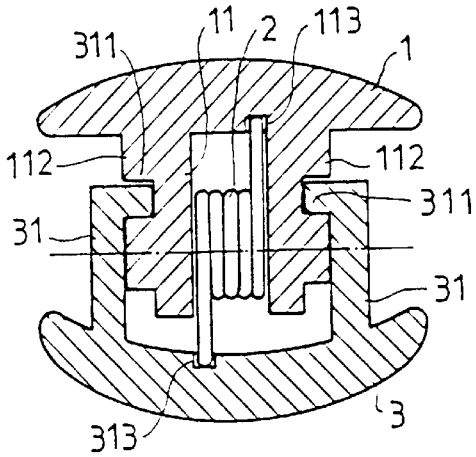
FIG. 5 is a sectional view taken along line 5—5 in FIG. 4.

In assembly, an end of the torsion spring 2 is placed into the first retaining groove 113 of the first body 1 that is preferably located under the mounting seat 1. A tool (not labeled) is used to retain the torsion spring 2 in place, as shown in FIG. 2. The first body 1 is moved toward the second body 3, in which the circular protrusions 111 are passed through the notches 312 of the annular walls 311 of the engaging pieces 31, respectively, as shown in FIG. 3. Next, the other end of the torsion spring 2 is inserted into the second retaining groove 313 that is preferably located adjacent to one of the engaging pieces 31, as shown in FIG. 4. Since two ends of the torsion spring 2 bear against the first body 1 and the second body 3, respectively, the circular protrusions 111 of the mounting seat 11 of the first body 1 are restrained in the annular walls 311 of the engaging pieces 31 of the second body 3 to thereby prevent the circular protrusions 111 from being disengaged via the notches 312 of the engaging pieces 31, best shown in FIG. 5. Thus, when the bodies 1 and 3 are pressed by their first ends where the mounting seat 11 and the engaging pieces 31 are mounted, respectively, the other ends of the bodies 1 and 3 move away from each other, yet the circular protrusions 111 of the first body 1 move along an inner peripheries of the annular walls 311 of the second body 3 without the risk of disengagement of the circular protrusions 111 from the engaging pieces 31.

Preferably, the first body 1 and the second body 3 include a plurality of anti-slip members 12 and 32, respectively. The anti-slip members 12 and 32 are arranged in a manner that they are alternately disposed when the hair holder is in a closed position shown in FIG. 4 to increase the hair retaining effect of the hair holder.

Figure 6:
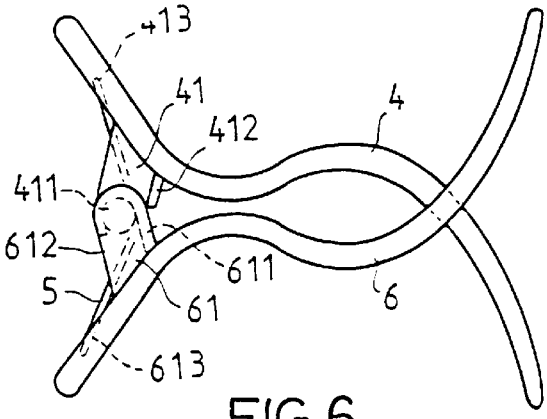
FIG. 6 is a side view illustrating a second embodiment of the hair holder in accordance with the present invention.

FIG. 6 illustrates a second embodiment of the hair holder in accordance with the present invention, wherein the hair holder includes a first body 4, an elastic member 5 (e.g., a torsion spring), and a second body 6. The first body 4 includes a mounting seat 41 formed on an end of a side thereof and a first retaining groove 413 defined in the end of the side thereof. The mounting seat 41 includes a protrusion 411 on each of two opposite end faces thereof. The mounting seat 41 further includes two restraining blocks 412 formed adjacent to each of two ends of a lateral side thereof. The second body 6 includes two spaced engaging pieces 61 formed on an end of a side thereof and a second retaining groove 613 defined in the end of the side thereof. Each engaging piece 61 includes an annular wall 611 with a notch 612. Such a structure is identical to that disclosed in the first embodiment, except for that the first body 4 and the second body 6 have a number of bristles (not labeled) for engaging with hair.

Figure 7:
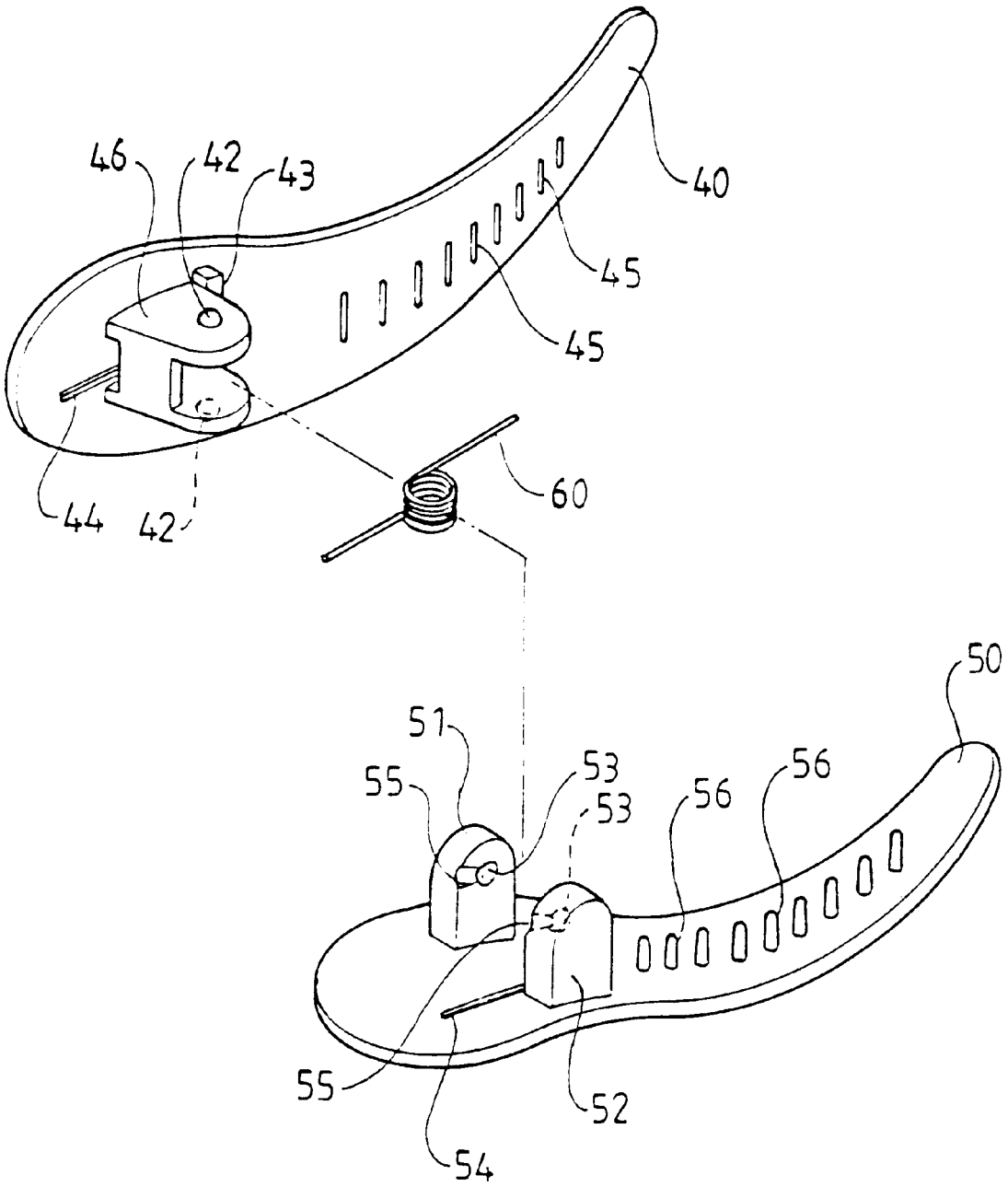
FIG. 7 is an exploded perspective view of a third embodiment of the hair holder in accordance with the present invention.

FIG. 7 illustrates a third embodiment of the hair holder in accordance with the present invention, wherein the hair holder includes a first body 40, an elastic member 60 (e.g., a torsion spring), and a second body 50. The first body 40 includes a mounting seat 46 formed on an end of a side thereof and a first retaining groove 44 defined in the end of the side thereof. The mounting seat 46 includes a semi-spherical knurl 42 on each of two opposite end faces thereof. The mounting seat 46 further includes two restraining blocks 43 formed adjacent to each of two ends of a lateral side thereof The second body 50 includes two spaced engaging pieces 51 formed on an end of a side thereof and a second retaining groove 54 defined in the end of the side thereof. The engaging pieces 51 include two mutually facing sides that have aligned positioning depressions 53. A guiding groove 55 extends from each positioning depression 53 to an associated end edge of the engaging piece 51. The torsion spring 60 is mounted in the mounting seat 46 of the first body 40, wherein two ends of the torsion spring 60 are received in the retaining grooves 44 and 54, respectively. The semi-spherical knurls 42 are fittingly received in the positioning depressions 53 of the engaging pieces 51, respectively to thereby retain the torsion spring 60 in the mounting seat 46 by the restraining block 43 and the retaining grooves 46. The guiding groove 55 allows easy insertion of the associated semispherical knurl 42 into the associated positioning depression 53.

Figure 8:
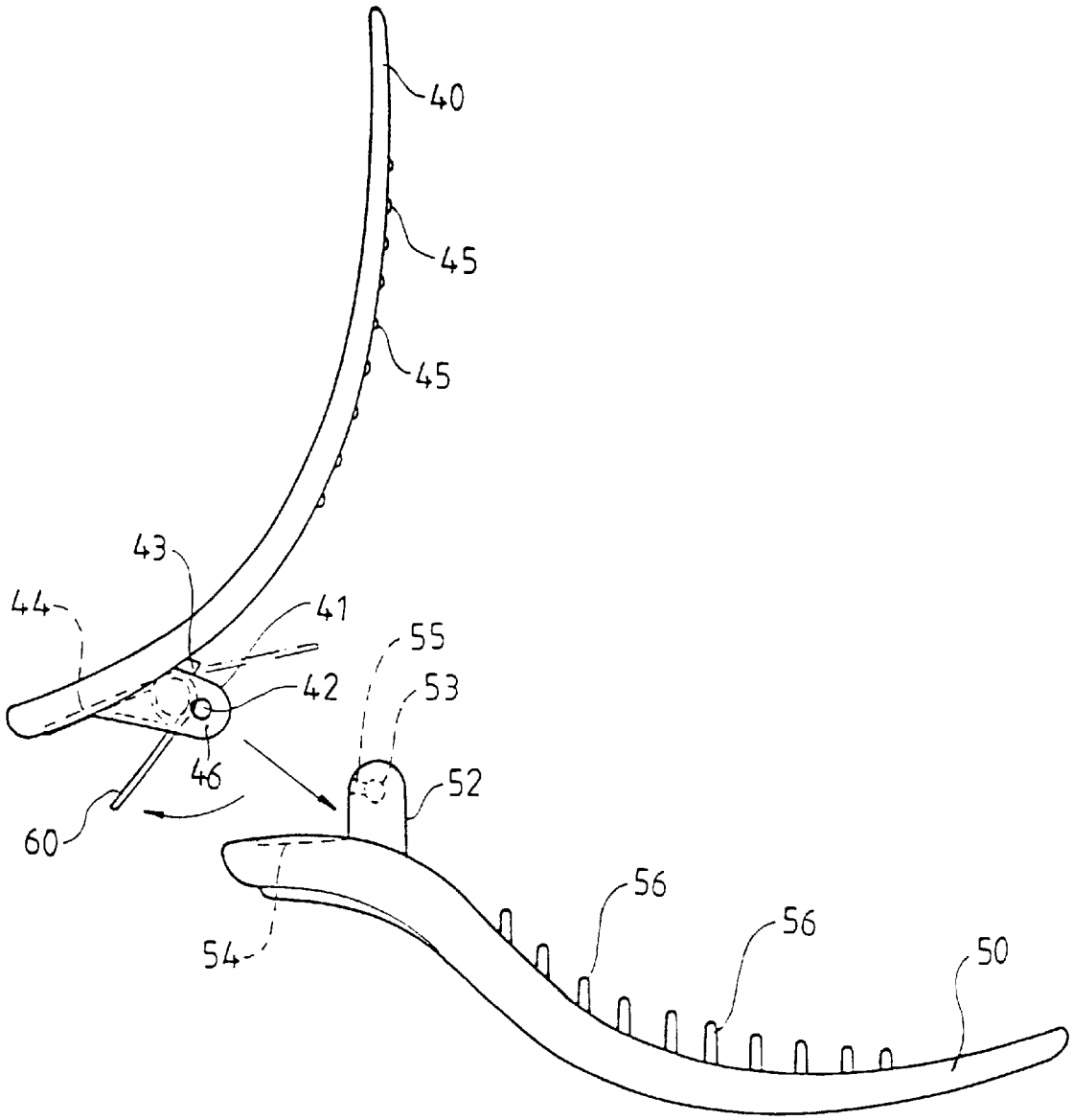
FIG. 8 is a side view illustrating assembly of the third embodiment of the hair holder in accordance with the present invention.
Figure 9:
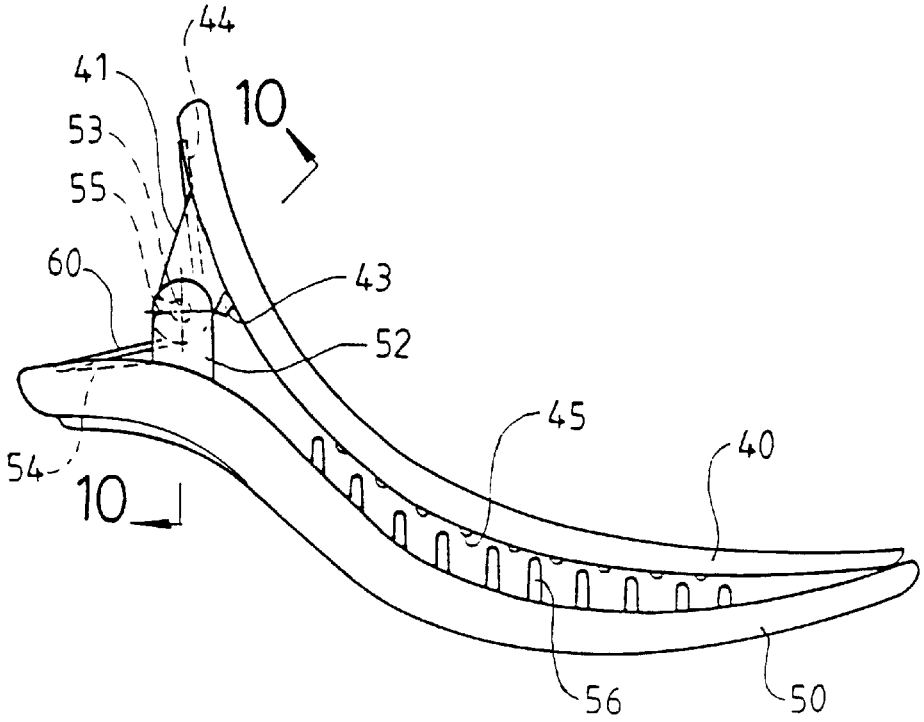
FIG. 9 is a side view of the third embodiment of the hair holder in accordance with the present invention.
Figure 10:
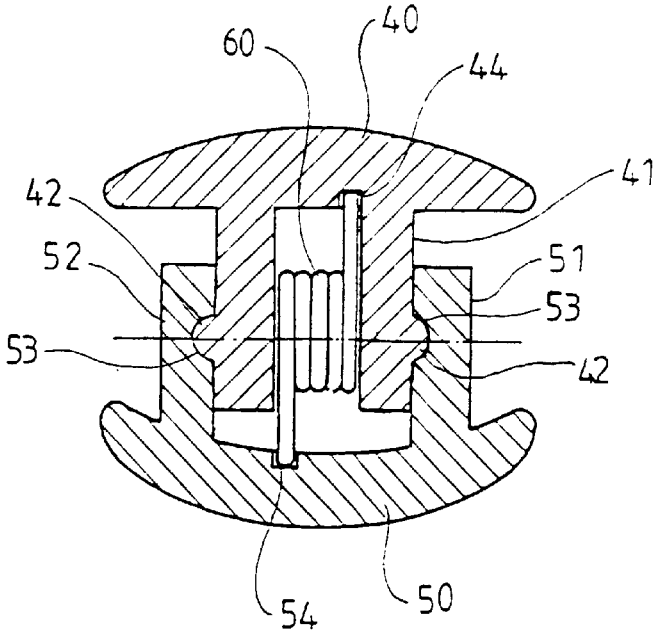
FIG. 10 is a sectional view taken along line 10—10 in FIG. 9.

In assembly, referring to FIG. 8, an end of the torsion spring 60 is placed into the retaining groove 44 of the first body 40 and the other end of the torsion spring 60 is inserted into the retaining groove 54 of the second body 50. Next, the semi-spherical knurls 42 are fitted into the positioning depressions 53 under the guidance of the guiding grooves 55 to complete the assembly procedure, as shown in FIG. 9. Referring to FIG. 10, the first body 40 and the second body 50 may pivot smoothly relative to each other, as the semi-spherical knurls 42 are fittingly and pivotally received in the positioning grooves 53 without the risk of disengagement therebetween.

Preferably, the first body 40 and the second body 50 include a plurality of anti-slip members 45 and 56, respectively. The anti-slip members 45 and 56 are arranged in a manner that they are alternately disposed when the hair holder is in a closed position shown in FIG. 9 to increase the hair retaining effect of the hair holder.

According to the above description, it is appreciated that neither the mounting seat of the first body nor the engaging pieces of the second body require pivotal holes, while the pivotal pin is also not required. The assembly is simple and not time-consuming accordingly.

Although the invention has been explained in relation to its preferred embodiment, it is to be understood that many other possible modifications and variations can be made without departing from the spirit and scope of the invention as hereinafter claimed.

What is claimed is:

1. A hair holder comprising:

a first body including a mounting seat formed on an end thereof and a first retaining groove defined in the end thereof, the mounting seat including a protruded member, which is a semicircular on each of two opposite end faces thereof, the first body further including two restraining blocks formed thereon;

a second body including two spaced engaging pieces formed on an end thereof and a second retaining groove defined in the end thereof, each said engaging piece including means formed therein for rotatably pivotally holding the protruded members of the mounting seat of the first body; and an elastic member mounted in the mounting seat of the first body and having a first end retained in the first retaining groove and a second end retained in the second retaining groove;

said engaging piece further including a guiding groove which is extended to an edge of said engaging piece.

2. The hair holder as claimed in claim 1, wherein the protruded member is a circular protrusion.

3. The hair holder as claimed in claim 2, wherein the means for pivotally holding the protruded member on each said engaging piece includes an annular wall with a notch to allow insertion of an associated said circular protrusion.

4. The hair holder as claimed in claim 1, wherein the elastic member is a torsion spring.

5. The hair holder as claimed in claim 1, wherein the first body includes a plurality of first anti-slip members formed thereon, and the second body includes a plurality of second anti-slip members formed thereon and located in a position corresponding to the first anti-slip members.

6. A hair holder comprising:

a first body including a mounting seat formed on an end thereof and a first retaining groove defined in the end thereof, the mounting seat including a protruded member comprising a semi-circular knurl on each of two opposite end faces thereof, the first body further including two restraining blocks formed thereon;

a second body including two spaced engaging pieces formed on an end thereof and a second retaining groove defined in the end thereof, each said engaging piece including a positioning depression for fittingly and pivotally receiving the associated semi-circualr knurl; and an elastic member mounted in the mounting seat of the first body and having a first end retained in the first retaining groove and second end retained in the second retaining groove.

* * * * *